United States Patent [19]

Mays

[11] 4,230,050

[45] Oct. 28, 1980

[54] PALLETS

[75] Inventor: Gerald F. Mays, Timonium, Md.

[73] Assignee: The Nelson Company, Baltimore, Md.

[21] Appl. No.: 35,441

[22] Filed: May 3, 1979

Related U.S. Application Data

[63] Continuation-in-part of Ser. No. 796,652, May 13, 1977, abandoned.

[51] Int. Cl.[2] ..... B65D 19/26; B65D 19/40

[52] U.S. Cl. ..... 108/51.1; 52/514

[58] Field of Search ..... 108/51.1, 53.1–57.1; 217/43 A; 206/386, 599, 600; 52/514

[56] References Cited

U.S. PATENT DOCUMENTS

| | | | |
|---|---|---|---|
| 2,014,892 | 9/1935 | Graham et al. | 52/514 X |
| 2,395,982 | 3/1946 | White | 108/57.1 |
| 2,470,514 | 5/1949 | Muller | 52/514 |
| 2,823,883 | 2/1958 | Bourdon | 108/57.1 |
| 2,919,090 | 12/1959 | DePew | 108/57.1 |
| 3,016,222 | 1/1962 | Arthur | 108/51.1 X |
| 3,122,108 | 2/1964 | Arthur | 108/51.1 |
| 3,251,322 | 5/1966 | Downs et al. | 108/51.1 |

FOREIGN PATENT DOCUMENTS

| | | | |
|---|---|---|---|
| 1481324 | 4/1969 | Fed. Rep. of Germany | 108/51.1 |
| 2301441 | 9/1976 | France | 108/56.1 |
| 1032178 | 6/1966 | United Kingdom | 108/51.1 |

OTHER PUBLICATIONS

"Nail Reinforced Pallet Stringers, A Pilot Study", E. George Stern, VPI Wood Research & Wood Construction Laboratory, Jul. 1972.

"Nail Reinforced Pallet Stringers, Part II", E. George Stern, VPI Wood Research & Wood Construction Laboratory, Sep. 1972.

"Better Utilization of Wood Through Assembly with Improved Fasteners", E. George Stern, VPI Research & Wood Construction Lab., Sep. 1972.

*Primary Examiner*—William E. Lyddane

*Attorney, Agent, or Firm*—A. W. Breiner

[57] ABSTRACT

Pallets for material transport and to be handled with fork lift trucks comprising deckboards nailed to vertically disposed stringers notched for engagement and lifting with the fork of a fork lift truck having a reinforcing metal pin disposed completely within the stringer between the stringer end and the fork lift engaging notch. The pins so positioned provide reinforcement, extending pallet life, without weakening of the deckboards or interfering with nailing and repairing operations.

17 Claims, 11 Drawing Figures

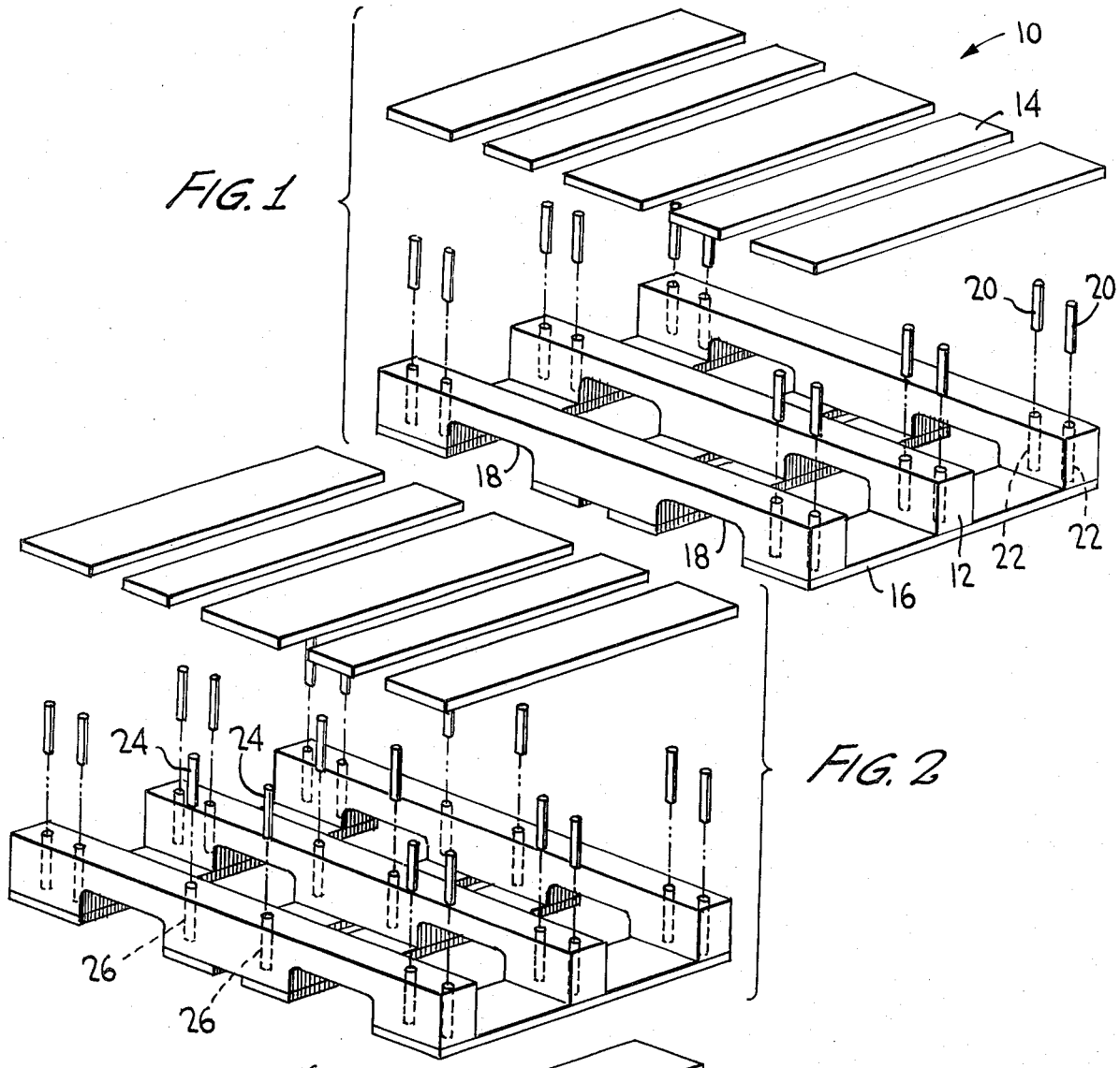
FIG. 1
FIG. 2
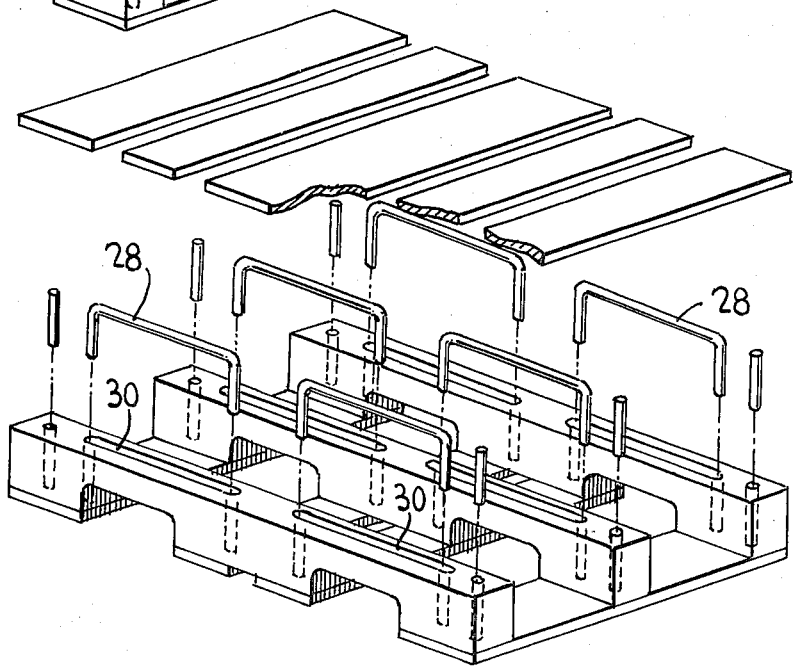
FIG. 3

PALLETS

This application is a continuation-in-part of application Ser. No. 796,652, filed May 13, 1977 now abandoned.

FIELD OF INVENTION AND BACKGROUND

This invention is directed to wooden pallets for material transport which are handled with fork lift trucks, and to their method of manufacture. More particularly, the invention is directed to pallets comprising deckboards nailed to vertically disposed notched stringers which are reinforced.

Pallets are used in ever-increasing number in commerce to transport virtually all types of merchandise. These pallets when loaded with merchandise almost by necessity are handled with fork lift trucks. When empty, however, they can be handled with fork lift trucks, but oftentimes are manually stacked or moved manually from one location to another. Pallets, therefore, while of simple design must meet numerous specifications, many of which are conflicting.

More specifically, pallets since they are a service item must be relatively inexpensive. To be inexpensive, they must be made of materials of relatively low cost and must be fabricated in a manner which will make most effective use of labor. Moreover, since the pallets are at times handled manually and since they are shipped from place to place with merchandise, they must be relatively light in weight in addition to having high structural strength. Most pallets, therefore, are made of wood and comprise vertical stringers with deckboards nailed thereto, top and bottom. For efficient construction the stringers are cut to the proper length. To facilitate handling with fork lift trucks, it is preferable to pick up the pallets on the side as opposed to an end of the pallet and, accordingly, the stringers are also notched for entrance of the fork of the fork lift truck. After cutting to proper length and notching, the stringers are fed to automatic stringer "feed boxes," with the deckboards then being applied and nailed with nail handguns or automatic nailers.

In spite of the acceptance of wood as the logical choice for pallet construction, pallets constructed from wood are subject to damage or breakage due to heavy loading and in being subjected to substantial mechanical impact from the fork end of the fork lift truck due at times to simple operator carelessness or indifference. Breakage in pallets with notched stringers occurs most often at the pallet end substantially immediately adjacent to the stringer notch. In order to reduce breakage and to increase the strength of wood pallets, various modifications to pallets have been suggested including incorporating metal braces between the stringers and deckboards; applying metal bands to the pallets at strategic points; reinforcing of the stringers by nailing; as well as constructing the pallets with bolts and/or metal pins extending through the stringer and deckboards. These efforts have been unacceptable to large users for various reasons. Metal braces and metal bands applied to the pallets not only increase material cost and at times make the pallets unacceptably heavy, but also increase labor costs during the course of construction and in large measure preclude the use of conventional automatic stringer feed boxes and nailing machines. Moreover, a pallet containing the metal braces and/or bands are difficult to repair once damaged since the conventional method of cutting the nails between the deckboards and stringers or otherwise conventional methods of pulling the nails connecting the deckboards and stringers cannot be conveniently employed. Nail reinforcement, while providing some improvement, has been limited by the lack of rigidity provided by reinforcement with relatively flexible nails driven into the stringers. Bolts and pins extending through the stringers and deckboards, while improving structural integrity, again greatly increase cost both from the standpoint of initial construction and repair. In the initial construction it is necessary to drill the deckboards and stringers in substantially perfect alignment and then insert the bolts. In order to avoid having boltheads or nuts interfere with the stacking of merchandise on the pallets and/or interfering with the setting down of the pallets and/or damaging merchandise when one loaded pallet is placed on another loaded pallet, the boltheads and nuts must be countersunk to provide a flush surface. This further increases the cost of the manufacturing operation and also requires the use of relatively thick deckboards for adequate strength. The countersinking of the boltheads into the deckboards also provides a weakened area at the point of countersinking, causing the deckboards to break at the weakened point.

OBJECTS OF INVENTION AND GENERAL DESCRIPTION

Accordingly, a primary object of the present invention is to provide a wooden pallet including notched vertical stringers having increased structural integrity.

It is another object of the present invention to provide a wooden pallet having reinforced notched vertical stringers which can be fabricated with conventional automatic equipment.

It is another object of the present invention to provide a method of constructing reinforced pallets in a rapid and efficient manner.

It is another object of this invention to provide pallets having notched vertical stringers which eliminate the need for lower or bottom deckboards.

It is another object of this invention to provide pallets wherein cleaved stringers can be repeatedly repaired by forcing together the cleaved stringer parts.

These and other objects of the invention will be clearly apparent from the following description and drawing.

Briefly, the aforesaid and other objects of the invention are accomplished by constructing pallets from deckboards nailed to notched stringers and including a metal pin or a pin of another material having structural strength greater than that of wood between the end and notch of conventionally used stringers. The pin is completely enclosed within the stringer. In fabrication of the improved pallet, the stringers are cut to proper length and notched as conventionally done. However, the stringers are then drilled in the vertical direction either completely through or substantially through and a pin inserted. The pins are positioned in the stringer so as not to interfere with the nailing of deckboards with automatic nailers or the like. The stringers with the pin inserted are then used in the fabrication of the pallet in a conventional manner as, for example, by feeding the stringers into automatic stringer feed boxes and applying the deckboards, top and bottom, with nail handguns or automatic nailers whereby the reinforcing pins are enclosed and interlocked within the stringer.

The pallets made in accordance with the present invention have greatly improved strength particularly at the ends of the pallet or stringer adjacent to the notch where notched pallets are most often damaged by being struck with the tine of the fork end of a fork lift truck or the like. The structural strength of the pallets is fully equivalent or greater than the structural strength of pallets using deck bolts or rods. However, unlike with the use of bolts, the pallets can be rapidly constructed using conventional automated equipment without weakening of the deckboards through drilling and countersinking of boltheads, or the like. Of equal or greater importance, however, is that when a pin-reinforced stringer is struck by the tines of a fork lift truck the pin, although not preventing the splitting of the stringer which is a virtual impossibility, arrests or stops the splitting or cleaving of the stringer end substantially at the pin. Although the stringer is cleaved and in part separated, the relative movement between the steel pin and the wooden stringer permits the forcing together of the separated stringer parts by pounding or the like and the pallet retained in normal service.

As a further embodiment for providing improved pallets, a U-shaped rod can be inserted running lengthwise of the stringer, extending over the notched portions of the stringer with the ends of the U extending vertically down into the stringer. The rod is fitted into a groove in the stringer so as not to interfere with deckboard placement.

As a still further embodiment in manufacturing reinforced pallets, U-shaped rods can be utilized extending endwise from stringer to stringer of the pallet and extending vertically downward into the stringer. This embodiment provides improved structural strength to the pallets and, further, helps to hold the stringers of the pallet in squared relation, relieving the stress on the deckboards. The rods, however, unless countersunk by notching the stringers can interfere with conventional manufacturing operations and, accordingly, is only to be used for special application. Similarly, the U-shaped rods extending across from the stringer to stringer of the pallet can be inserted in the bottom of the stringers so as to eliminate need for deckboards.

DETAILED DESCRIPTION AND DRAWING

Having described the invention in general terms, specific embodiments will be described with reference to the drawing wherein:

FIG. 1 is an exploded elevational view of a preferred embodiment showing pin placement;

FIG. 2 is an exploded elevational view of the pallet of FIG. 1 utilizing a greater number of reinforcing pins;

FIG. 3 is an exploded elevational view of a modification to the embodiment of FIG. 1 utilizing pins and U-shaped members in the pallet;

Figure 4:
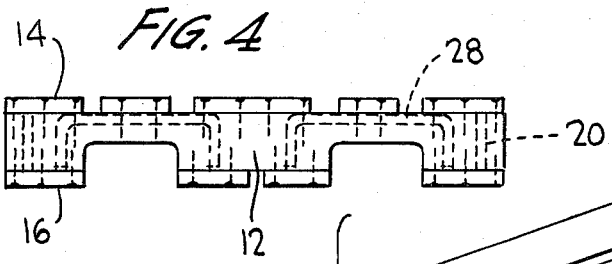
FIG. 4 is a side view of the pallet of FIG. 3.

Referring to the drawing wherein like elements are identified with like numerals, FIG. 1 shows a preferred construction of pallet 10 where three wooden stringers 12 having notches 18 cut therein have top boards 14 and bottom boards 16 nailed thereto. Vertically positioned at each end of the three notched stringers are two pins 20 completely enclosed within drilled holes 22. The pins are positioned in the stringer so as not to interfere with nailing of the deckboards to the stringers with nailguns or automatic nailers. These pins provide surprisingly improved life to the pallet, preventing the most commonly occurring breakage at the stringer end adjacent the notched opening for receiving the fork of a fork lift truck.

Although two pins are shown in the embodiment of FIG. 1, one pin will provide substantial improvement in pallet life. Moreover, substantial improvement is provided if pins are inserted only in the outermost stringers, i.e., not in the middle stringer as shown in FIG. 1. As an alternative embodiment, the middle stringer can be made of plastic or the like. However, it is not desirable from a practical standpoint to not include pins in all of the stringers or to use stringers of diverse materials because of the manner of constructing pallets. Preferably all of the stringers will be identical so that there is no need to pick and choose stringers during the course of fabrication.

FIG. 2 modifies the embodiment of FIG. 1 to the extent that pins 24 are also inserted in holes 26 inward from and immediately adjacent the notches in the stringers. In FIG. 3 the embodiment of FIG. 2 is modified by replacing the pins 20 and 26 most nearly adjacent each side of notch 18 with a U-shaped member 28. Member 28 is recessed into notches 30 so that there is no interference with the placement of deckboards onto the stringers. This embodiment provides additional protection against breakage of the stringer horizontally along the top of notches 18. FIG. 4 shows the positioning of the U-shaped member 28 and pins 20 in phantom lines within the finished pallet.

Figure 5:
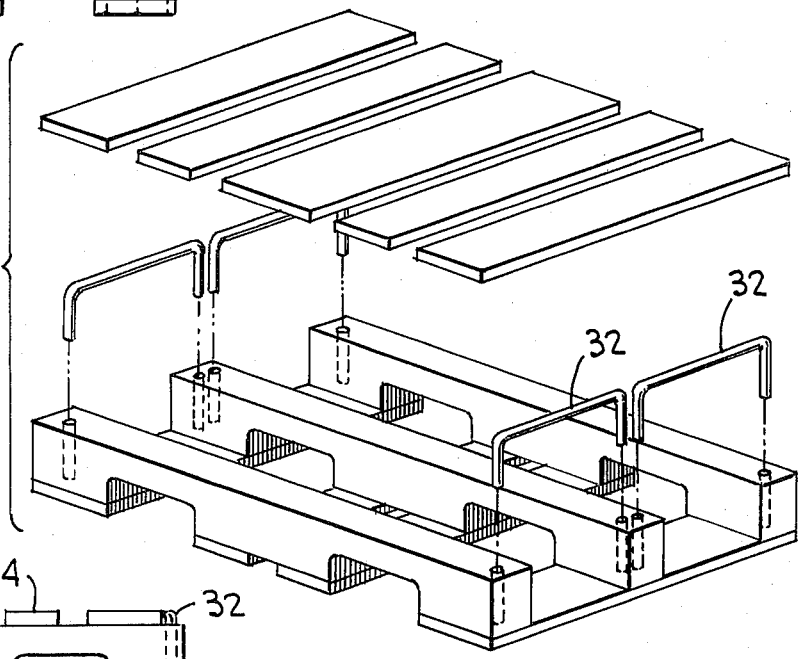
FIG. 5 is an exploded elevational view of another embodiment of improved pallets employing U-shaped members.
Figure 6:
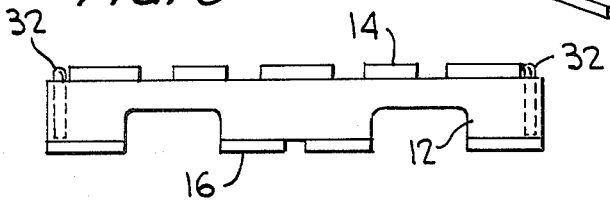
FIG. 6 is a side view of the pallet of FIG. 5.

FIGS. 5 through 11 show a second embodiment of the invention and modifications thereof. As illustrated in FIG. 5, pins 20 are not employed. However, reinforcing strength is provided to the pallets by insertion of U-shaped members 32 vertically into the ends of stringers 18. In the embodiment shown in FIGS. 5 and 6, the U-shaped member 32 is not recessed into the stringer. It is possible, however, and at times may be preferable to recess the U member as shown, for example, in FIGS. 9 and 10. In the embodiment of FIGS. 5 and 6, one U-shaped member ties one outermost stringer to the center stringer and another ties the other outermost stringer to the center stringer.

Figure 7:
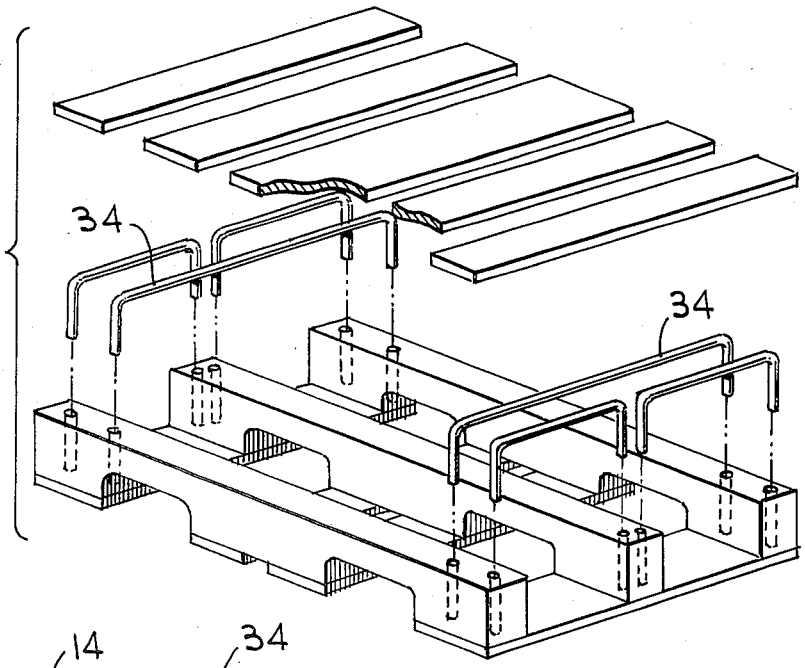
FIG. 7 is an exploded elevational view of a modification of the embodiment of FIG. 5.
Figure 8:
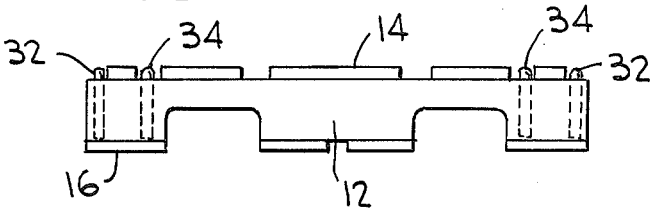
FIG. 8 is a side view of the embodiment of FIG. 7.
Figure 9:
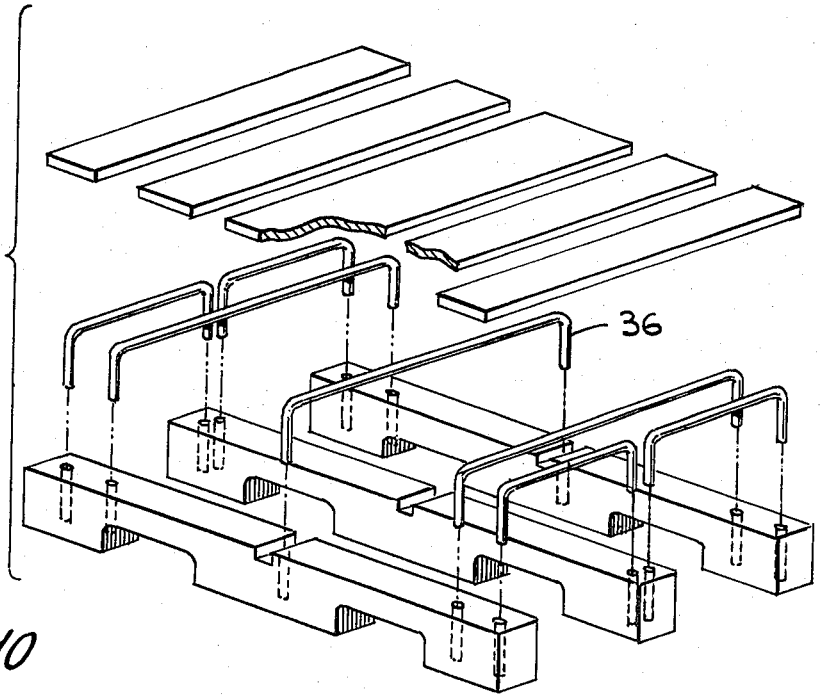
FIG. 9 is an exploded elevational view of a modification of FIG. 7.
Figure 10:
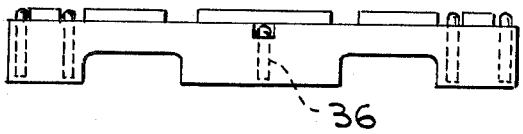
FIG. 10 is a side view of the embodiment of FIG. 9.

In FIGS. 7 and 8 there is included a second U-shaped member 34 at each end of the stringers extending across the two outermost stringers. In FIGS. 9 and 10 there is included an additional U member 36 extending from the two outermost stringers and positioned at the approximate center of the stringers. Only U-shaped member 36 is indented. It will be apparent, however, that any or all of U members 32, 34 or 36 can be recessed within the stringers.

Figure 11:
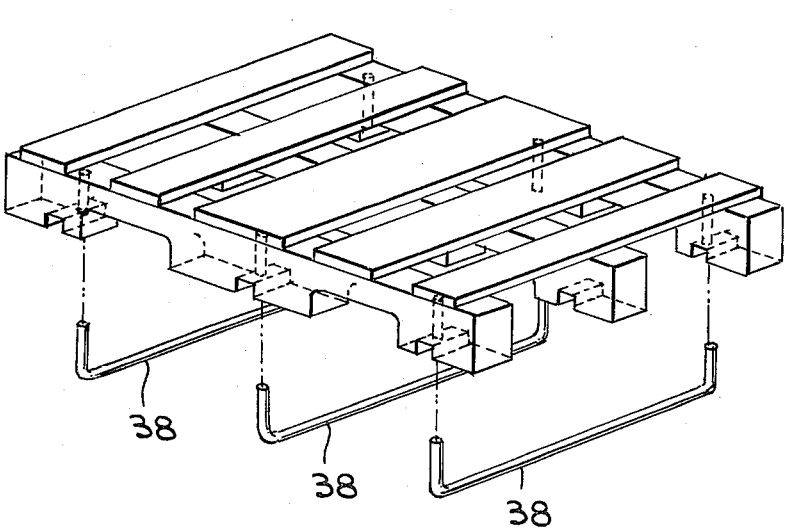
FIG. 11 is still another embodiment of improved pallets utilizing U-shaped rod members in lieu of bottom deckboards.

In FIG. 11 U-shaped members 38 are positioned at the bottom of the stringer and indented into the stringer in order that pallets with notched stringers are provided, eliminating the bottom deckboard.

Throughout the various embodiments shown in the drawing, it is clear that the reinforcing members are positioned so as to avoid interference with the loading of merchandise onto the pallets and, further, there is no interference with placement of the pallets including the stacking of one pallet upon another. The reinforced pallets have a substantially enhanced lifetime both from breakage and also from the standpoint of becoming misshaped through extensive use or mishandling.

The pins which are used in the embodiment of FIGS. 1–4 preferably are metal coated with cement. The cement-coated pins can be inserted in the stringer at the time of notching and drilling and will not fall out during subsequent handling of the stringers. It is also possible to use plain metal pins and drill the holes so that the pins fit snugly. It has been found that pins having a diameter of three-eighths of an inch are adequate to reinforce a stringer which is about one and one-half to two inches in width, and to arrest a split in the stringer when struck by the tine of a fork lift truck. In the event the width of the stringers increase, the diameter of the pin may also be desirably increased. Preferably, the pin will extend substantially all the way through the vertical length of the stringer. However, the pin can be somewhat shorter than the stringer with reinforcement being provided. Although the reinforcing pin, as above stated, can have a rough surface including grooves or the like to provide a snug fit thereby precluding the falling out of the pins prior to the placement of deckboards over the pin in pallet fabrication, the pins must have a surface sufficiently smooth to permit relative movement between split stringer parts and the pin so as to permit repeated repair of a stringer by the forcing together of cleaved stringer parts around the pin without destruction of the stringer. Moreover, the pin during fabrication of the total pallet must be interlocked within the stringer either as a result of a snug or interference fit provided by a roughened or grooved pin surface or by forcing a smooth surfaced pin into a smaller diameter hole, or as a result of the positioning of the deckboards to prevent the pin from being displaced when the stringer is split.

Heretofore the invention has been described with reference to notched pallets which permit four-way entrance with a fork lift truck. However, the concept of the invention can be applied as well to two-way pallets, i.e., where the fork lift truck enters only from two directions. In two-way pallets the stringers are not notched. As an example, with two-way pallets the pins will protect the leading edge of the stringers and, furthermore, the U-shaped members will function to protect the lead boards of the pallets. Additionally, the U-shaped members will add structural strength to the center of the pallets while carrying heavy loads. In accordance with the present invention, as is apparent from the drawings and the description of the drawings, the reinforcing pin is satisfied either by a pin completely enclosed or substantially completely enclosed within the stringer, or by the ends of a U-member which extend through or substantially through the stringer to the extent that the ends of the U-member satisfies the requirements of the reinforcing pin, i.e., having a diameter sufficient to arrest the cleavage of the stringer when the stringer is struck by the tine of a fork lift truck, and having a surface which will permit relative movement between the split stringer parts so as to allow repeated repair of a stringer by the forcing together of cleaved stringer parts around the pin.

Although various embodiments have been discussed and shown, it will be apparent to one skilled in the art that additional modifications can be made with respect to the number and positioning of the pins and U-shaped members. The preferred embodiments shown herein are not to be construed as a limitation of the invention.

It is claimed:

1. A pallet for material transport to be handled with a fork lift truck comprising a plurality of notched longitudinally extending stringers and transverse deckboards fixedly secured to said notched longitudinally extending stringers, at least the outermost stringers of said plurality of stringers being wooden and having a drilled hole at each end and adjacent said longitudinal notch and a reinforcing pin in each said drilled hole enclosed and interlocked within said stringer, said notch being sufficiently large to receive a tine of a fork of a fork lift truck, and said pin in said drilled hole in interlocking relation with said stringer being of a diameter sufficient to arrest cleavage of said stringer when said stringer is struck by the tine of a fork lift truck, and said pin having a surface sufficiently smooth to enable relative movement between split stringer parts and said pin subsequent to any such cleavage so as to permit repeated repair of a stringer by the forcing together of cleaved stringer parts around said pin.

2. The pallet of claim 1 wherein each stringer of said pallet has said drilled hole and reinforcing pin as stated.

3. The pallet of claim 2 wherein each stringer has two drilled holes and a reinforcing pin in each hole at each end of said stringers as stated.

4. The pallet of claim 3 wherein each stringer has an additional drilled hole and reinforcing pin positioned in said stringers inward of each notch.

5. The pallet of claim 1 wherein a U-shaped member is positioned horizontally over each notch of said outermost stringers with the ends of said U-shaped member extending vertically downward into said stringer, said U-shaped member being completely recessed into said stringer.

6. A pallet for material transport to be handled with a fork lift truck comprising a plurality of notched longitudinally extending wooden stringers, transverse deckboards fixedly secured to said notched longitudinally extending stringers, said stringers having a drilled hole at each end and a reinforcing U-shaped member extending from each outermost stringer end to a center stringer end and extending into said drilled hole and substantially through said stringers, said U member at least at the ends thereof extending into said drilled hole in said stringer being of a diameter sufficient to arrest cleavage of said stringer when said stringer is struck by the tine of a fork lift truck, and having a surface sufficiently smooth to enable relative movement between split stringer parts and said ends of said U-shaped member subsequent to any such cleavage so as to permit repeated repair of a stringer by forcing together of cleaved stringer parts around said end, said U-shaped member being at most flush with said deckboards and said notch being sufficiently large to receive the fork of a fork lift truck.

7. The pallet of claim 6 wherein a second U-shaped member extends across the ends of said pallet with the ends of said U-shaped member extending downwardly into and substantially through the two outermost stringers of said pallet.

8. The pallet of claim 7 including an additional U-shaped member extending across the center of said pallet with the ends of said U-shaped member extending downwardly into and substantially through the outermost stringers.

9. A pallet for material transport to be handled with a fork lift truck comprising a plurality of notched longitudinally extending wooden stringers, transverse deckboards fixedly secured to said notched longitudinally extending stringers, said stringers having a drilled hole at each end and a reinforcing U-shaped member extending across each of the ends of said pallet, with the ends of said U-shaped member extending downwardly into said drilled hole and substantially through the two outermost stringers of said pallet, said U member at least at the ends thereof extending into said drilled hole in said stringer being of a diameter sufficient to arrest cleavage of said stringer when said stringer is struck by the tine of a fork lift truck, and having a surface sufficiently smooth to enable relative movement between split stringer parts and said ends of said U-shaped member subsequent to any such cleavage so as to permit repeated repair of a stringer by forcing together of cleaved stringer parts around said end, said U-shaped member being at most flush with said deckboards.

10. The pallet of claim 9 wherein additional U-shaped members extend from each outermost stringer end to a center stringer end and extend downwardly into and substantially through said stringers, said U-shaped member being at most flush with said deckboards.

11. A pallet for material transport to be handled with a fork lift truck comprising a plurality of longitudinally extending wooden stringers, transverse deckboards fixedly secured to the top of said longitudinally extending stringers, said stringers having a drilled hole at each end and a U-shaped member extending across each of the ends of said pallet, with the ends of said U-shaped member extending downwardly into said drilled hole and substantially through the two outermost stringers of said pallet, said U member at least at the ends thereof extending into said drilled hole in said stringer being of a diameter sufficient to arrest cleavage of said stringer when said stringer is struck by the tine of a fork lift truck, and having a surface sufficiently smooth to enable relative movement between split stringer parts and said ends of said U-shaped member subsequent to any such cleavage so as to permit repeated repair of a stringer by forcing together of cleaved stringer parts around said end, said U-shaped member being at most flush with said deckboards.

12. The pallet of claim 11 wherein additional U-shaped members extend from each outermost stringer end to a center stringer end and extend downwardly into and substantially through said stringers, said U-shaped members being at most flush with said deckboards.

13. A pallet for material transport to be handled with a fork lift truck comprising a plurality of notched longitudinally extending stringers, transverse deckboards fixedly secured to the top of said notched longitudinally extending stringers, said stringers having a drilled hole at each end and a U-shaped member extending across the bottom of the outermost stringers at each end thereof and projecting upwardly into said drilled hole and substantially through said stringers, said U member at least at the ends thereof extending into said drilled hole in said stringer being of a diameter sufficient to arrest cleavage of said stringer when said stringer is struck by the tine of a fork lift truck, and having a surface sufficiently smooth to enable relative movement between split stringer parts and said ends of said U-shaped member subsequent to any such cleavage so as to permit repeated repair of a stringer by forcing together of cleaved stringer parts around said end, said U-shaped members being recessed into said stringers, and said notch being sufficiently large to recieve the fork of a fork lift truck.

14. The pallet of claim 13 including a U-shaped member extending across the bottom of said stringers at the centers thereof and projecting upwardly into and substantially through said outermost stringers, said U-shaped member being recessed.

15. A pallet for material transport to be handled with a fork lift truck comprising a plurality of longitudinally extending stringers, transverse deckboards fixedly secured to said stringers, at least the outermost stringers of said plurality of stringers being wooden and having drilled holes at each end thereof and a reinforcing pin in each of said drilled hole enclosed and interlocked within said stringer, and said pin in said drilled hole in interlocking relation with said stringer being of a diameter sufficient to arrest cleavage of said stringer when said stringer is struck by the tine of a fork lift truck, and said pin having a surface sufficiently smooth to enable relative movement between split stringer parts and said pin subsequent to any such cleavage so as to permit repeated repair of a stringer by the forcing together of cleaved stringer parts around said pin.

16. The pallet of claim 15 wherein each stringer of said pallet has said drilled hole and reinforcing pin as stated.

17. The pallet of claim 16 wherein each stringer has two drilled holes and a reinforcing pin in each hole at each end of said stringers as stated.

* * * * *